United States Patent [19]

Ardito

[11] 4,074,806

[45] Feb. 21, 1978

[54] TABLET DISPENSING CONTAINER

[75] Inventor: Gerald J. Ardito, Old Westbury, N.Y.

[73] Assignee: Deena Packaging Industries, Inc., Ridgewood, N.Y.

[21] Appl. No.: 770,010

[22] Filed: Feb. 18, 1977

[51] Int. Cl.[2] ..... B65D 83/04; B65D 85/56; B65D 47/04; G07F 11/00

[52] U.S. Cl. ..... 206/531; 206/534; 206/539; 220/339; 221/87

[58] Field of Search ..... 206/531, 534, 538, 539, 206/1.5; 220/339, 337; 221/87, 26, 25, 5, 6; 222/541

[56] References Cited

U.S. PATENT DOCUMENTS

| | | | |
|---|---|---|---|
| 2,317,860 | 4/1943 | Sorensen | 206/531 |
| 3,279,651 | 10/1966 | Thompson | 206/531 |
| 3,324,996 | 6/1967 | Jordt | 206/531 |
| 3,904,075 | 9/1975 | Richardson et al. | 206/531 |

*Primary Examiner*—William T. Dixson, Jr.
*Attorney, Agent, or Firm*—Marn & Jangarathis

[57] ABSTRACT

There is disclosed an integrally formed tablet dispensing container for receiving a tablet package having a plurality of individually enwrapped tablets and comprised of a top or cover member and a bottom or body member. The body member is formed with a plurality of orifices juxtaposed to said tablets. The top member is provided with a plurality of hinged dispensing members which after the dispensing of a tablet from the tablet package assumes a tablet dispensed position.

5 Claims, 6 Drawing Figures

FIG. 4
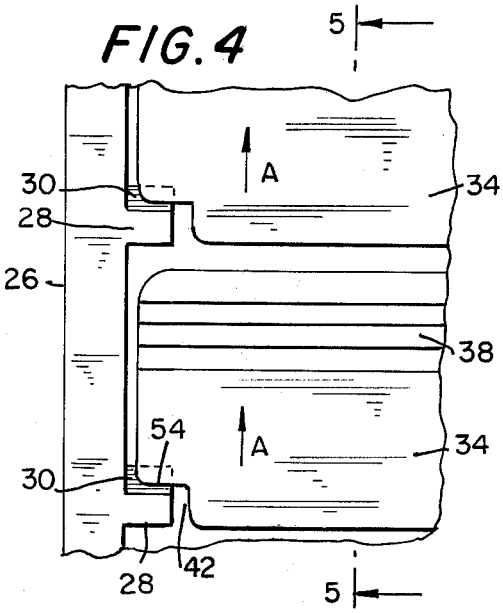
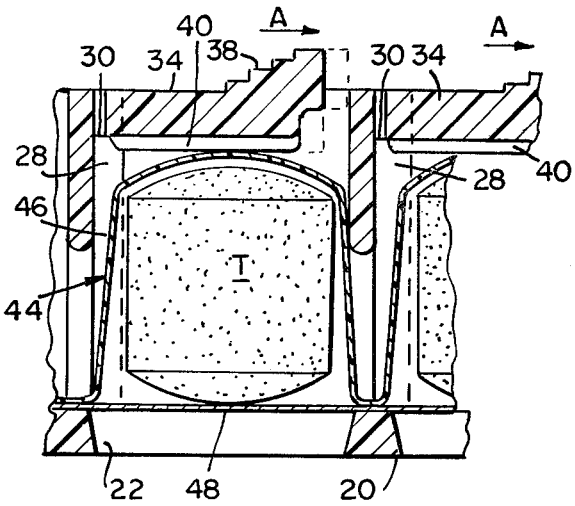
FIG. 5
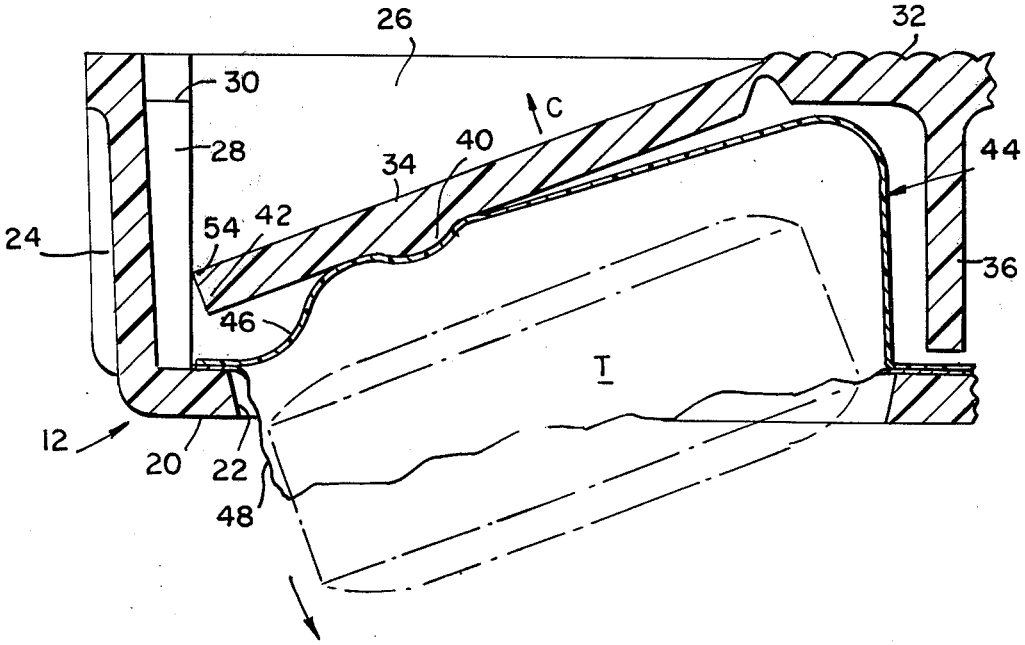
FIG. 6

TABLET DISPENSING CONTAINER

This invention relates to a container, and more particularly to a container for tablets and the like having time dispensing features and safety latch features to minimize inadvertent dispensing of a tablet.

BACKGROUND OF THE INVENTION

The container art is replete with diverse types of containers or receptacles for tablets, pills, capsules and the like for the selective dispensing of a tablet from a package containing a plurality of tablets. Additionally, the art is replete with safety features as well as time and dosage features.

OBJECTS OF THE INVENTION

An object of the present invention is to provide a novel tablet dispensing container.

A further object of the present invention is to provide a novel tablet dispensing container having a safety assembly for preventing inadvertent dispensing of a tablet from a package thereof.

Still another object of the present invention is to provide a novel tablet dispensing container having time and dosage features.

SUMMARY OF THE INVENTION

These and other objects of the present invention are achieved by an integrally formed container for receiving a tablet package having a plurality of individually enclosed tablets and comprised of a top or cover member and a bottom or body member. The body member is formed with a plurality of orifices juxtaposed to said tablets. The top member is provided with a plurality of hinged dispensing members which after the dispensing of a tablet from the tablet package assumes a tablet dispensed position, i.e the user can recognize that a corresponding tablet has been dispensed from a certain portion of the tablet package. Each dispensing member cooperates with a support means to provide a safety feature as more fully hereinafter described.

BRIEF DESCRIPTION OF THE DRAWINGS

A better understanding of the present invention as well as other objects and advantages thereof will become apparent upon consideration of the detailed description thereof, especially when taken with the accompanying drawings, wherein like numerals designate the like parts throughout; and wherein:

FIG. 4 is a partial enlarged top view of the container of FIG. 1 taken along the lines 4—4 of FIG. 3;

FIG. 5 is a partial enlarged cross-sectional side view of the present invention taken along the lines 5—5 of FIG. 4; and FIG. 6 is a partial enlarged cross-sectional side view of the container of FIG. 1 illustrating the dispensing of a tablet.

DETAILED DESCRIPTION OF THE DISCLOSURE

Figure 1:
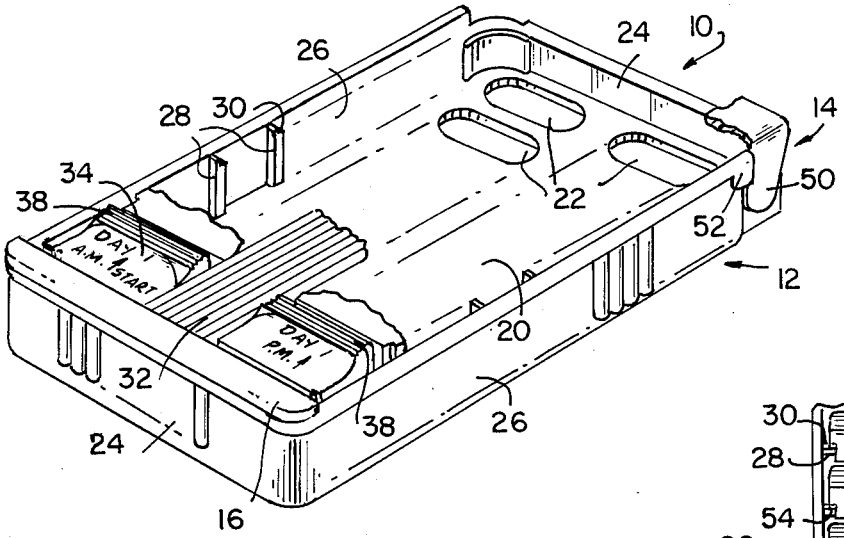
FIG. 1 is an isometric top view (partially broken) of one embodiment of the present invention illustrating the container in a closed position.
Figure 2:
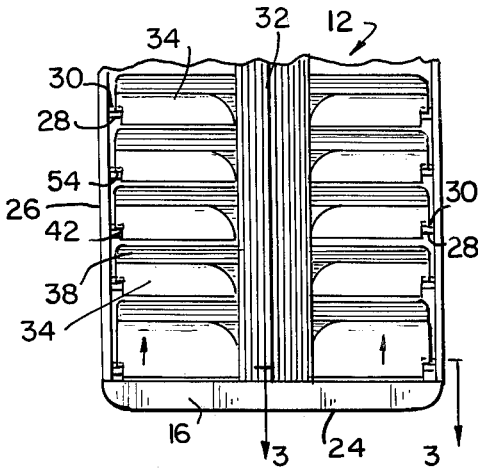
FIG. 2 is a partial top view of the container of FIG. 1.
Figure 3:
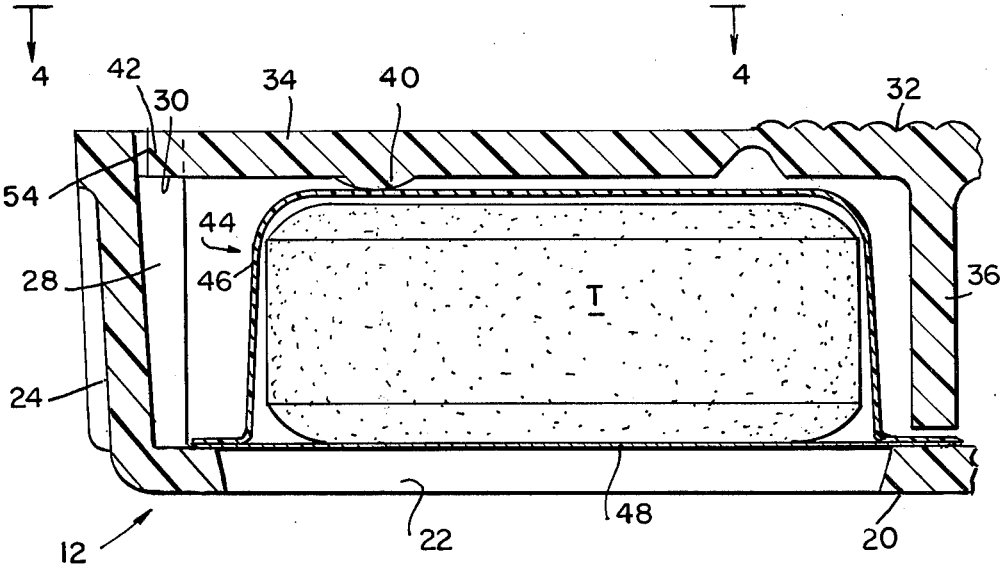
FIG. 3 is an enlarged elevational cross-sectional side view of the container of FIG. 1 taken along the lines 3—3 of FIG. 2.

Referring to FIGS. 1 to 6 illustrating one embodiment of the present invention, there is provided a unitarily molded container, generally indicated as 10, comprised of a body or bottom member and a top or cover member (partially shown), generally indicated as 12 and 14, respectively, hingeably affixed to one another at 16. The body member 12 in which a tablet package 44 is disposed is formed of a bottom wall 20 formed with a plurality of uniformally disposed slots 22 (all not shown), end walls 24 and side walls 26. The inner surface of each side wall 26 is formed with a plurality of vertically extending support columns 28 including a notched portion 30 proximate to the upper edge of the side walls 26. The cover member 14 is formed with a centrally disposed top support member 32 from which are hingeably mounted a plurality of laterally extending tablet dispensing elements 34. Preferably, the cover member includes a centrally disposed downwardly extending wall member 36 (See FIG. 6) for greater container integrity.

Each tablet dispensing element 34 is generally rectangularly-shaped and is formed with a serrated or stepped upper surface 38 to facilitate manipulation thereof and with a downwardly extending projection ridge 40 to assist in effectly expelling a tablet from the tablet package. Each tablet dispensing element 34 is formed with an excised portion 42 to permit the tablet dispensing elements 34 to seat on the notched portion 30 of the support columns 28.

In operation, a tablet package, generally indicated as 44, formed of an upper PVC body 46 and a foiled bottom 48 and including a plurality of tablets disposed in a manner to align with the slots 22 of the bottom wall 20 of the container 10 is positioned within the body member 12. The cover member 14 is lowered and locked in a closed position by the cooperation of a shoulder 50 and a detent 52 formed on the body and cover members 12 and 14, respectively. To dispense a tablet, a respective tablet dispensing element 34 is first caused to be moved forward parallel with respect to the body member 12 thereto to disengage the tablet dispensing elements 34 from the notched portion 30 of the column 28 (as indicated by the arrow A in FIG. 4). Such arrangement constituting a safety feature in that inadvertent downward pressure on a tablet dispensing element 34 does not result in downward movement of the tablet dispensing element 34. After disengaging the tablet dispensing element 34 from the notched portion 30 of the column 28, the tablet dispensing element 34 is caused to be moved downwardly by downward pressure to deform the PVC body 46 and cause the tablet to break the foiled bottom 48 of the tablet package 42 about an area of the tablet T being dispensed and to cause the tablet T to pass through the slot 22 in the bottom wall 20 of the body member 12 (as illustrated by the arrow B in FIG. 6).

A tablet dispensed position of each tablet dispensing element 34 results by the inherent resilient nature of the material forming the container to return to the initial tablet dispensing position by forcing the tablet dispensing element 34 backward parallel to the body member 12.

Upon release of the tablet dispensing element 34, the tablet dispensing element 34 is caused to move back towards end wall 24 proximate the hinge (opposite to the motion of arrow A) together with an upward movement (as indicated by the arrow C in FIG. 6). The total return of upward movement of the tablet dispensing element 34, however, is prevented by contact of an outer edge 54 of the tablet dispensing element 34 with the respective column 28 as illustrated in FIG. 6. Thus, a user handling the package has a visual representation of dispensed and undispensed tablets.

After complete dispensing of all tablets from the tablet package 16, the cover member 14 is caused to be unlocked by outward pressure on the cover member 14 to disengage the detents 52 from the shoulders 50 of the body member 12. The spent package is removed and a new package inserted. Upon closing and locking of the cover member 14 to the body member 12, the tablet dispensing elements 34 are caused to again come to rest on the notched portions 30 of the columns 28 thereby permitting continued re-use of the container 10.

The container of the present invention is formed of a thermoplastic material such as polyethylene, polypropylene and the like, capable of being made in thin sections suitable for creation of the hinge effect, generally utilizing injection molding techniques. However, it is understood to one skilled in the art that other manufacturing and fabricating techniques may be utilized.

While the container of the present invention has been described with reference to a container having uniformly spaced slots and corresponding tablet dispensing elements it will be appreciated that the container may be formed with elements and slots of one spacing on one side and of another spacing on the other side if different tablets were to be dispensed for treating a common ailment.

While the locking elements have been described as being formed on the front walls of the members, it will be understood that such locking elements may be formed on the side walls, or on a combination of the walls thereof.

I claim:

1. An integral thermoplastic tablet dispensing container which comprises:

a body member including a bottom wall, side walls and end walls, said bottom wall being formed with a plurality of preselectedly spaced slots, said side walls being formed with a plurality of preselectedly spaced columns;

a cover member hingeably connected to said body, said cover member formed with a T-shaped top member having preselectedly spaced laterally extending tablet dispensing elements correspondingly positioned with respect to said slots formed in said bottom wall of said body member, said tablet dispensing elements resting on said column in a closed position of said container; and means for locking said cover member to said body member.

2. The container as defined in claim 1 wherein each tablet dispensing element is caused to contact a respective column and prevent said tablet dispensing element from resting on said column after said tablet dispensing element has been lowered in the process of dispensing a tablet thereby giving visual recognition of a tablet dispensed mode.

3. The container as defined in claim 2 wherein each tablet dispensing element is provided with an upper serrated surface.

4. The container as defined in claim 1 wherein said cover member includes a transversely and downwardly extending wall member.

5. The container as defined in claim 1 wherein each of said tablet dispensing elements is formed with a downwardly extending projection ridge.

* * * * *